US005178278A

United States Patent [19]

Oliverius

[11] Patent Number: 5,178,278

[45] Date of Patent: Jan. 12, 1993

[54] STERILE CONTAINER WITH TEAR-AWAY THROAT

[76] Inventor: Maynard F. Oliverius, 1413 SW. Auburn Rd., Topeka, Kans. 66615

[21] Appl. No.: 814,485

[22] Filed: Dec. 30, 1991

[51] Int. Cl.[5] ..... B65D 33/20

[52] U.S. Cl. ..... 206/455; 378/167; 383/93

[58] Field of Search ..... 53/449; 206/455, 438; 378/167; 383/7, 93

[56] References Cited

U.S. PATENT DOCUMENTS 3,843,041 10/1974 Oliverius ..... 206/455
3,941,245 3/1976 Oliverius ..... 383/7
3,988,873 11/1976 Oliverius ..... 53/449
4,057,731 11/1977 Loseff ..... 378/167

*Primary Examiner*—Jimmy G. Foster
*Attorney, Agent, or Firm*—Litman, McMahon & Brown

[57] ABSTRACT

An improved sterile container device, having a tear-away throat, which includes walls defining a cavity having a closed end and an open throat, a first cuff connected to the walls adjacent to the open throat, a shield and a second cuff in overlying relation to the first cuff and upper portions of the walls adapted to protect same from contamination by a non-sterile article being inserted into the cavity, and a sleeve for removing the shield from the cavity and for cooperatively effecting a separation of the device into a sterile portion containing the contaminated article and a discard portion. A pressure sensitive adhesive provides a sealing arrangement for sealing the non-sterile article in the sterile portion.

10 Claims, 2 Drawing Sheets

Fig.4.
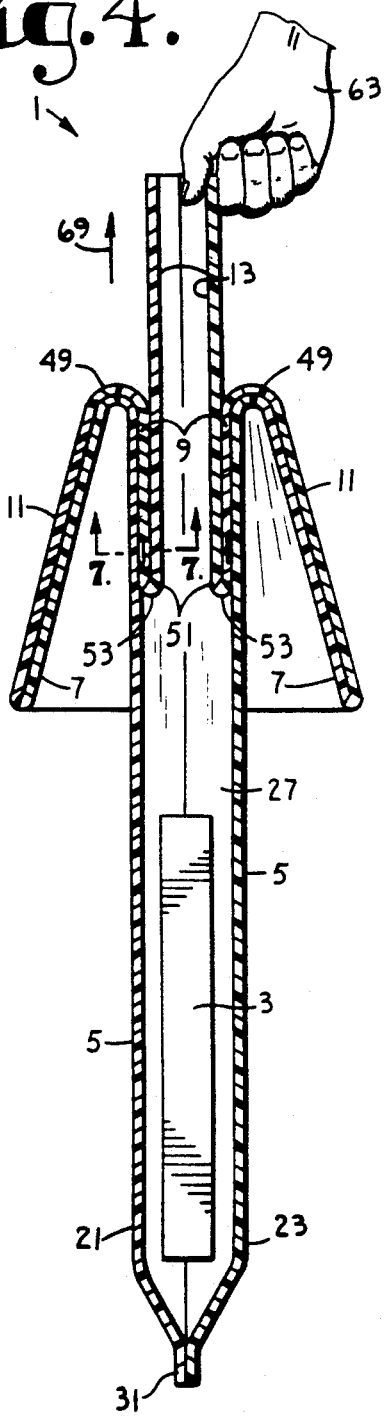
Fig.5.
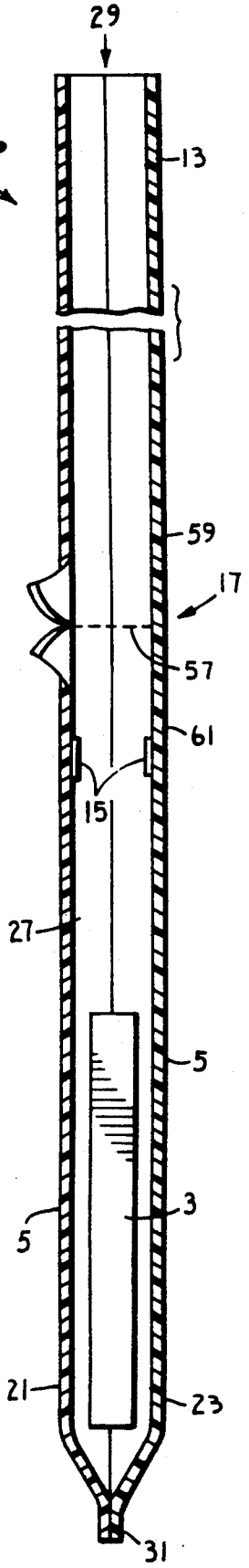
Fig.7.
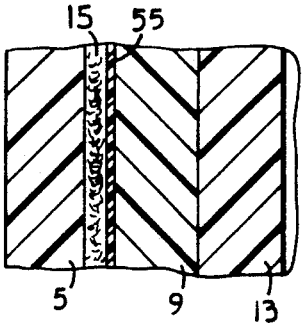
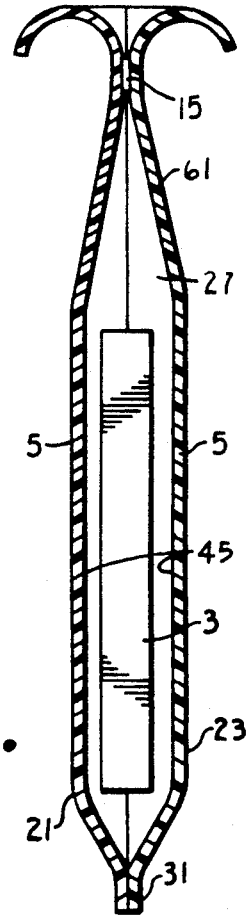
Fig.6.

STERILE CONTAINER WITH TEAR-AWAY THROAT

BACKGROUND OF THE INVENTION

1. Field of the Invention

The present invention relates to a sterile container and, more particularly without limitation, to a sterile container for enclosing a non-sterile material or article therein, such as an X-ray cassette.

2. Description of the Related Art

Currently, one of the problems associated with surgery is sterilization of X-ray cassettes in the form of film holders which are used when taking X-rays with either stationary or portable units in a sterile environment. X-ray cassettes vary in size from approximately 8×10 inches to about 12×18 inches and in weight up to about 10 pounds. Unfortunately, X-ray cassettes cannot be autoclaved due to destructive damage to the X-ray film arising from the effects of heat and moisture associated therewith.

Exposing of the X-ray cassettes to ethylene oxide gas, another sterilizing agent, in addition to cost, also presents problems. Use of ethylene oxide gas has been found to generate heat, which causes the familiar difficulties to the X-ray film usually associated with heat. Also, ethylene oxide gas may create adverse chemical reactions with the X-ray film, thereby reducing its reproductive qualities.

In surgery, a non-sterile X-ray cassette must be isolated from the sterile site or field of the operation. Heretofore, many of the available containers were similar to plastic trash bags or sandwich bags. Another way sometimes used to avoid contamination of the site or field of the operation was to place the contaminated or non-sterile X-ray cassette in a sterile pillow case, such as one which had been autoclaved.

As a non-sterile person or nurse attempted to drop or move the contaminated or non-sterile cassette into the sterile bag, which was being held open by a sterile person, the edges of the sterile bag were sometimes touched by non-sterile surfaces, which could lead to subsequent contamination of other, sterile surfaces. Extra caution and effort had to be exerted by the sterile person holding the sterile bag or pillow case receiving the non-sterile article to carefully place or roll all of the contaminated surfaces and edges to the inside of the sterile bag or pillow case in order to assure that neither the sterile person nor any portion of the exterior of the bag or pillow case was contaminated by the procedure.

One solution of the problem is shown in my patent entitled, CASSETTE BAG, U.S. Pat. No. 3,843,041. In the packaging shown therein, a tubular member is releasably held in the container to protect certain exterior portions of the container from contact with a contaminated or non-sterile article or material inserted therein. After the article or material is placed inside of the container, the tubular member is removed and discarded with the non-sterile article or container safely sealed inside, leaving exterior surfaces which have retained their sterility through the procedure.

Another solution of the problem is shown in my patent entitled, STERILE CONTAINER FOR ENCLOSING A CONTAMINATED ARTICLE THEREIN, U.S. Pat. No. 3,941,245. In the packaging shown therein, an inner container is releasably supported in a sterile outer container which protects the latter from contact with a contaminated or non-sterile article or material being inserted into the inner container. The procedure of inserting the non-sterile article or material into the inner container effectively causes the inner container to be completely enveloped by the outer container. After sealing the outer container, only sterile exterior surfaces remain.

What is needed, however, is a sterile container for enclosing a contaminated or non-sterile material or article therein whereby manufacturing costs can be reduced while maintaining highly reliable and sterile handling standards, such as a singular, integrally constructed container with a tear-away throat.

SUMMARY OF THE INVENTION

An improved sterile container device, having a tear-away throat, is provided for enclosing a contaminated or non-sterile material or article whereby the article may be used in a sterile environment. The container device includes walls defining a cavity having a closed end, an open end or throat, and closed sides. A first cuff is spaced adjacent to the throat in overlying relation with the walls.

Shielding means including a shield and a second cuff are spaced in overlying relationship to an upper portion of the walls and the first cuff in order to protect same from contamination by a contaminated or non-sterile article or material being inserted through said throat to be deposited in the cavity.

A sleeve is secured to a cavity end of the shield and extends outwardly from the throat whereby the shield can be conveniently removed from the cavity after insertion of the non-sterile article into the cavity via the throat. During insertion of the non-sterile article into the cavity, the device is adapted such that a sterile portion of the container device is handled only by a sterile person and a discard portion of the container device is handled only by a non-sterile person who also handles the non-sterile article which is inserted in the cavity.

After removal of the shield from the cavity, the sterile person effects sealing closure of the non-sterile article in the sterile portion of the device by exerting inwardly directed pressure on the walls such that a pressure-sensitive adhesive in contact with itself seals the non-sterile article in a lower portion of the cavity. A perforation, which partitions the device into the sterile portion and the discard portion, is adapted to effect separation of the sterile portion, with the non-sterile article safely sealed therein, from the discard portion as those portions are snapped away from each other.

Principal Objects and Advantages of the Invention

Therefore, the principal objects and advantages of the invention include: providing a sterile container which is adapted to receive a non-sterile or contaminated article or material therein wherein the container is operating-room safe; providing such a sterile container which is constructed of a material which is substantially resistant to the generation of static electricity and which is largely free from particulate matter; providing such a sterile container which has a singular, integral construction; providing such a sterile container which has a tear-away throat whereby unneeded, otherwise contaminating, portions can be conveniently removed and discarded after sealing of a contaminated or non-sterile article or material in a cavity portion contained in the container; providing such a sterile container which is adapted to maintain sterile exterior surfaces such that sterile operating room personnel may position the container and the article enclosed therein next to an operative site with complete confidence that no contamination will be introduced into the field of the operation; providing such a sterile container having portions thereof positioned in overlying or protective relation with respective walls of the container adjacent an open end thereof whereby a sterile person may position their hands in engagement with sterile exterior surfaces of the container between a cuff and the exterior surfaces; providing such a sterile container wherein the exterior surfaces thereof are maintained in a sterile condition before and after receiving a contaminated or non-sterile article or material into a cavity portion within the container; providing such a sterile container which is adapted to receive a contaminated or non-sterile article or material therein and which has means for thereafter effecting a positive closure of the container; and to provide such a sterile container adapted to receive a non-sterile or contaminated article therein which is economical to manufacture, simple and reliable to use, positive in operation, and particularly well adapted for the proposed use.

Other objects and advantages of this invention will become apparent from the following description take in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a transverse sectional view of the sterile container, showing a sleeve being pulled outwardly after insertion of the contaminated or non-sterile article or material into the sterile container.

FIG. 5 is a fragmentary, transverse sectional view of the sterile container, showing the sterile container after extension of the tear-away throat therefrom.

FIG. 6 is a transverse sectional view of a remaining portion of the sterile container after separation of the sterile container at the tear-away throat.

FIG. 7 is an enlarged and fragmentary, cross-sectional view of the sterile container generally along line 7—7 as shown in FIG. 4, showing a pressure-sensitive adhesive, according to the present invention.

DETAILED DESCRIPTION OF THE INVENTION

Figure 1:
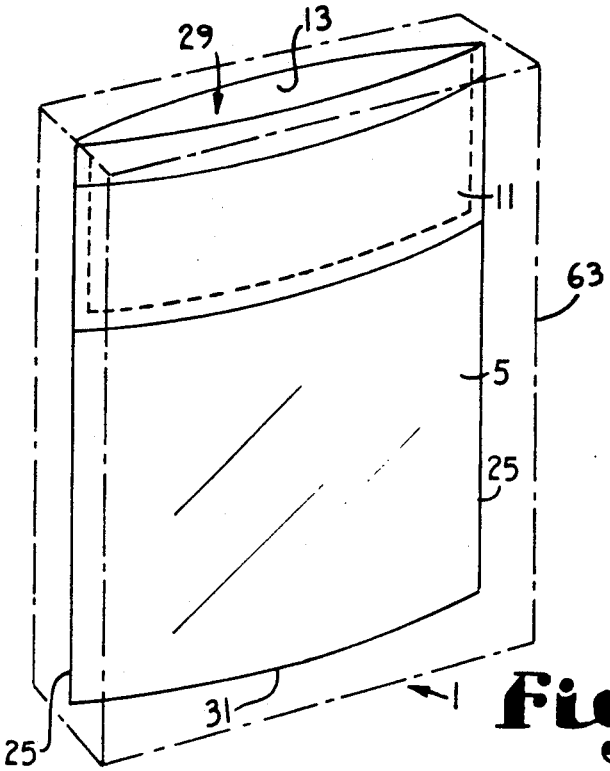
FIG. 1 is a perspective view of a sterile container having a tear-away throat and showing a package in phantom, according to the present invention.

As required, detailed embodiments of the present invention are disclosed herein; however, it is to be understood that the disclosed embodiments are merely exemplary of the invention, which may be embodied in various forms. Therefore specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a sterile container device having a tear-away throat, in accordance with the present invention, as shown in FIGS. 1 through 7. The container device 1 is adapted to receive and enclose a contaminated or non-sterile material or article 3 therein, e.g., an X-ray cassette. The container device 1 includes walls 5, a first cuff 7, shielding means such as a shield 9 and a second cuff 11, first removing means such as a sleeve 13, sealing means such as a pressure-sensitive adhesive 15, and second removing means such as a tear-away throat 17.

The materials used for constructing the container device 1 are preferably suitable for use in operating and other sterile rooms, such as non-woven fabric which is substantially resistant to the generation of static electricity and which is substantially free of particular material. Plastics, such as polyethylene, polyvinyl chloride and the like, and linen have been found to provide satisfactory characteristics for the container device 1 when used in an operating room.

The walls 5 generally comprise a pair of opposing side walls 21 and 23, which are suitably joined together along edges 25 thereof, such as by heat sealing, to thereby define a cavity 27 having an open end or throat 29 and a closed end 31.

In the illustrated embodiment, the contaminated article 3 is shown having a generally rectangular shape. It is to be understood, however, that the wall 5 are flexible and the cavity 27 may have an desired shape to substantially conform to any shape of the contaminated article 3 to be received and enclosed therein as hereinafter described.

Figure 3:
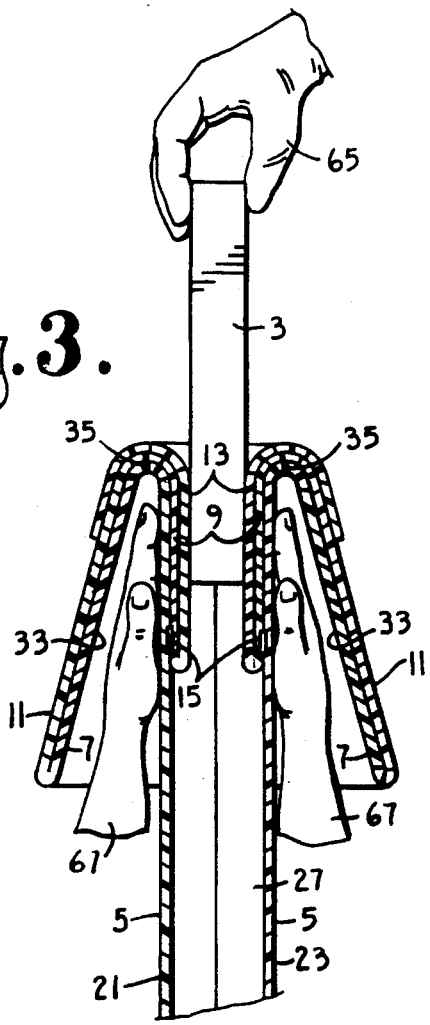
FIG. 3 is a fragmentary, transverse sectional view showing the sterile container being held by a sterile person as a contaminated or non-sterile article or material is being introduced into the sterile container by another person.

The first cuff 7 is preferably constructed integrally with the walls 5 and includes first cuff walls 33 spaced from and in overlying relation with the walls 5 and joining with the walls 5 generally along a first fold line 35 adjacent to the throat 29, as shown in FIG. 3.

The shield 9 has a cavity end 37 disposed within the cavity 27, generally dividing the cavity 27 into an upper cavity portion 39 having upper cavity Walls 41 and a lower cavity portion 43 having lower cavity walls 45. Preferably, maximum isolation or separation is maintained between the contaminated article 3 and the exterior surfaces of the walls 5. Thus the shield 9 extends from within the cavity 27 to the upper extremity of the throat 29, generally terminating in the proximity of the first fold line 35, in order to protect the upper cavity walls 41 from contact with the contaminated article 3 as the contaminated article 3 is displaced through the throat 29 into the lower cavity portion 43, as shown in FIG. 3 and as hereinafter described.

Figure 2:
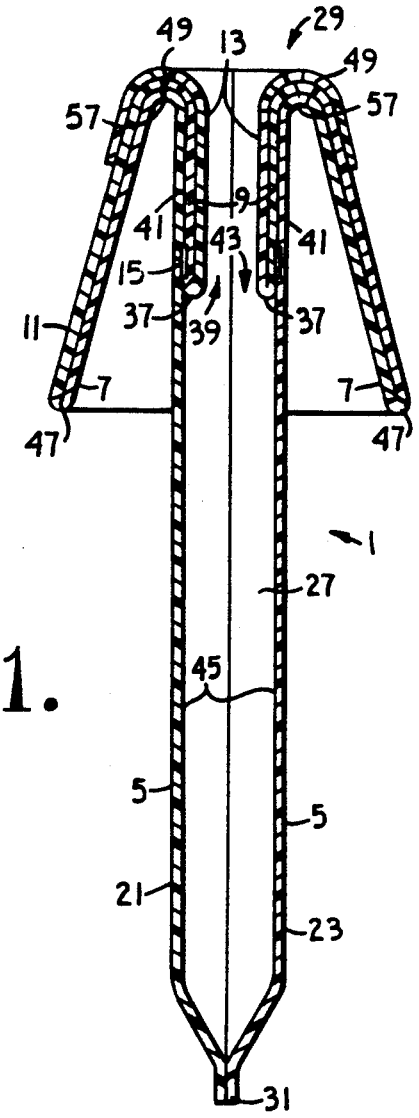
FIG. 2 is a transverse sectional view through the sterile container and showing the relative positions of the component parts.

To isolate and separate the contaminated article 3 from the first cuff 7, the second cuff 11 is spaced adjacent to the throat 29 in overlying relation with the first cuff 7 such that the second cuff 11 protects the first cuff 7 from contact with the contaminated article 3 as the contaminated article 3 is displaced through the throat 29. Preferably, the second cuff 11 is constructed integrally both with the first cuff 7, joining generally along a second fold line 47, as shown in FIG. 2, and with the shield 9, joining generally along a third fold line 49, adjacent to the throat 29, as shown in FIG. 4.

The sleeve 13, which has a cavity end 51 disposed within the cavity 27, extends from within the cavity 27 to beyond the throat 29 and generally folds onto the second cuff 11 in overlying relation, as shown in FIG. 3. Preferably, the sleeve 13 is constructed integrally with the shield 9, joining generally along a fourth fold line 53 between the upper cavity portion 39 and the lower cavity portion 43, as shown in FIG. 4.

The adhesive 15 is generally mounted on opposing interior surfaces of the upper cavity walls 41 in a continuous band, as indicated in FIG. 3. The adhesive 15 is adapted to effect sealing of the throat 29 after removal of the shield 9 and the sleeve 13 from the cavity 27 as hereinafter described. The adhesive 15 is preferably of the pressure-sensitive type which will adhere to itself, such as when the adhesive 15 on the side wall 21 is moved into engagement with the adhesive 15 on the side wall 23 by appropriately applying inwardly directed pressure to the side walls 21 and 23.

If desired, a protective strip 55, secured to the shield 9, can be adapted to pull away from the adhesive 15, as the shield 9 and the sleeve 13 are removed from the cavity 27, to thereby expose the adhesive 15 to itself for sealing purposes.

The tear-away throat 17 includes a score or perforation 57, or other similar arrangement, such that the container device 1 comprises a discard portion 59, lying to one side of the perforation 57, and a sterile portion 61, lying to the other side of the perforation 57 and containing the cavity 27. The perforation 57 is adapted such that the discard portion 59 can be separated from the sterile portion 61 by snapping the discard portion 59 outwardly from the sterile portion 61, as hereinafter described.

It is to be understood that the perforation 57 and the adhesive 15 may be spaced anywhere within the first cuff walls 33 and the upper cavity walls 41, so long as the perforation 57 is spaced relative to the adhesive 15 such that the adhesive 15 is affixed to the sterile portion 61.

The container device 1 is preferably packaged in a package 63 which is constructed of a material which is safe for use in an operating room, such as non-woven plastic fabric, e.g., polyethylene, polyvinyl chloride, and the like. Preferably, such material used for construction of the package 63 substantially resists movement into the package 63 of any agent which might contaminate the contents thereof.

It is preferable that the package 63 be sealed in a manner which will maintain the interior surfaces thereof and the contents therein, namely, the container device 1, in a sterile condition and which may be opened in a manner which maintains the interior surfaces of the package 63 and the container device 1 in a sterile condition, particularly during removal of the container device 1 from the package 63. Heat sealing of plastic to plastic or plastic to paper have been found to provide such a seal which can be opened by a non-sterile person 65 while maintaining the container device 1 in a sterile condition.

In use, the container device 1 for enclosing the contaminated article 3 therein and constructed as illustrated and described, is effective to enclose the article 3 within the sterile portion 61 of the container device 1 without contaminating either the exterior surfaces of the sterile portion 61 containing the contaminated article 3 or a sterile person 67 holding the encapsulated article 3.

In preparation for using the device, the package 63 is opened by any suitable person, such as a circulating nurse, and the container device 1 is dumped onto a sterile field, such as a sterile table covered with a sterile sheet (not shown), or the like. The container device 1 is then removed from the sterile field or removed from the package 63 by the sterile person 67, who holds the container device 1 by placing his hands on or adjacent exterior surfaces of the side walls 21 and 23 of the container device 1 and under the first cuff 7 with at least the tips of his fingers in supporting engagement with the first cuff 7, as shown in FIG. 3.

The container device 1, so supported, is adapted to receive the article 3 which is moved thereinto by the non-sterile person 65 by moving the article 3 through the throat 29, as shown in FIG. 3. The article 3 may come into engagement with the exposed surfaces of the sleeve 13 and the lower cavity walls 45, but do not come into contact with the upper cavity walls 41 or the outer surfaces of the sterile portion 61 of the container device 1.

After the article 3 is moved into the lower cavity portion 43, the non-sterile person 65 then removes the shield 9 from the cavity 27 by pulling outwardly on the sleeve 13, as indicated by the arrow designated by the numeral 69 in FIG. 4, as the sterile person 67 holds the sterile portion 61 of the container device 1. The areas of the container device 1, which would normally be subjected to contamination during the described procedure, are confined to the discard portion 59 of the container device 1.

After removal of the shield 9 and the sleeve 13 from the cavity 9, the lower cavity portion 43 with the contaminated article 3 therein is sealed by the sterile person 67 by appropriately exerting inwardly directed pressure on exterior surfaces of the side walls 21 and 23 to thereby effect sealing contact between the pressure-sensitive adhesive 15 on facing, interior surfaces of the side walls 21 and 23.

The sterile portion 61 is then grasp by the sterile person 67 and the discard portion 59 is grasp by the non-sterile person 65, with separation of the tear-away throat 17 effected by snapping the sterile portion 61 and the discard portion 59 away from each other, thereby tearing the container device 1 in two along the perforation 57. The sterile portion 61 then held by the sterile person 67, with the non-sterile article 3, e.g., an X-ray cassette, sealed and encapsulated therein, may be safely used adjacent to or in contact with a sterile area to be X-rayed without fear of contamination of the patient and without the necessity of sterilizing the X-ray cassette.

It is to be understood that while certain forms of the present invention have been illustrated and described herein, it is not to be limited to the specific forms or arrangement of parts described and shown.

What is claimed and desired to be secured by Letters Patent is as follows:

1. A container adapted to receive a non-sterile article, comprising:

(a) walls defining a cavity having an open, upper cavity portion and a lower cavity portion;

(b) a cuff spaced adjacent to said upper cavity portion in overlying relation with said walls;

(c) shielding means for shielding said upper cavity portion and said cuff from contact with the non-sterile article as the non-sterile article is moved through said upper cavity portion into said lower cavity portion; said shielding means including a shield positioned within said upper cavity portion;

(d) first removing means for removing said shield from said upper cavity portion;

(e) sealing means for sealing the non-sterile article within said lower cavity portion; and (f) second removing means comprising a weakened first portion of the container for removing a second portion of said container from a remainder of said container when the non-sterile article is sealed therein.

2. The container according to claim 1, wherein:

(a) said walls, said shielding means, said first removing means, said sealing means, and said second removing means are integrally constructed.

3. The container according to claim 2, wherein:

(a) said container is constructed of a non-woven plastic fabric characterized by being substantially resistant to the creation of static electricity.

4. The container according to claim 2, wherein:

(a) the non-sterile article which said container is adapted to receive is an X-ray cassette.

5. The container according to claim 1, wherein:

(a) said sealing means is positioned on interior surfaces of said walls and comprise adhesive in a band and underlies said shield.

6. The container according to claim 5, wherein:

(a) said adhesive is pressure-sensitive such that said upper cavity walls may be sealed together by adhesive-to-adhesive contact after movement of the article into the lower cavity portion and removal of said shield from said cavity.

7. A sterile container adapted to receive a non-sterile article, comprising:

(a) walls defining a cavity having an open end, a closed end, and closed sides; said cavity having an upper cavity portion with upper cavity walls and a lower cavity portion with lower cavity walls;

(b) a first cuff spaced adjacent said open end; said first cuff being in overlying relation with said walls; said first cuff joined to said walls along a first fold line;

(c) a shield having a cavity end disposed within said cavity; said shield extending from within said cavity such that said shield protects said upper cavity walls from contact with the non-sterile article as said non-sterile article is displaced through said upper cavity portion into said lower cavity portion;

(d) a second cuff spaced adjacent said open end; said second cuff in overlying relation with said first cuff such that said second cuff protects said first cuff from contact with the non-sterile article as the non-sterile article is displaced through said upper cavity portion into said lower cavity portion; said second cuff joined to said first cuff along a second fold line; said second cuff also joined to said shield along a third fold line;

(e) a sleeve connected to said shield; said sleeve extending from within said shield to beyond said open end; said sleeve joined to said shield along a fourth fold line; said sleeve adapted to remove said shield from said upper cavity portion;

(f) a pressure-sensitive adhesive for sealing the non-sterile article in said lower cavity portion after removal of said shield from said upper cavity portion; and (g) a perforation adapted to separate a portion of said container which may become contaminated as the non-sterile article in inserted into the container from a remaining portion of said container which, with the exception of said lower cavity walls which are sealed therein, remains uncontaminated after insertion of the non-sterile article into the container.

8. A sterile device for receiving a non-sterile article, comprising:

(a) walls defining a cavity having an open, upper cavity portion and a lower cavity portion with lower cavity walls;

(b) a first cuff spaced adjacent said open end; said first cuff being in overlying relation with said walls; said first cuff joined to said walls along a first fold line;

(c) a shield having a cavity end disposed within said cavity; said shield extending from within said cavity;

(d) a second cuff spaced adjacent said open end; said second cuff in overlying relation with said first cuff; said second cuff joined to said first cuff along a second fold line; said second cuff also joined to said shield along a third fold line;

(e) a sleeve connected to said shield; said sleeve extending from within said shield to beyond said open end; said sleeve joined to said shield along a fourth fold line; said sleeve adapted to remove said shield from said upper cavity portion; and (f) separation means for separating a portion of said device which may become contaminated from a remaining portion of said device which, with the exception of said lower cavity walls which are sealed therein, remains uncontaminated after insertion of the non-sterile article into the device.

9. The container according to claim 8, wherein:

(a) said container is constructed of a non-woven plastic fabric characterized by being substantially resistant to the creation of state electricity.

10. The container according to claim 8, wherein:

(a) the non-sterile article which said container is adapted to receive is an X-ray cassette.

* * * * *